US008902717B1

(12) United States Patent
Garzon

(10) Patent No.: US 8,902,717 B1
(45) Date of Patent: Dec. 2, 2014

(54) CLOCKWORK MECHANISM THAT ENABLES A SECOND HAND TO BE POSITIONED BELOW THE HOUR HAND AND THE MINUTE HAND ON A CLOCK FACE

(71) Applicant: Alex Garzon, Morrisville, PA (US)

(72) Inventor: Alex Garzon, Morrisville, PA (US)

( * ) Notice: Subject to any disclaimer, the term of this patent is extended or adjusted under 35 U.S.C. 154(b) by 0 days.

(21) Appl. No.: 14/221,918

(22) Filed: Mar. 21, 2014

Related U.S. Application Data

(60) Provisional application No. 61/830,634, filed on Jun. 3, 2013.

(51) Int. Cl.
*G04B 19/04* (2006.01)
*G04B 19/02* (2006.01)
*G04B 13/00* (2006.01)

(52) U.S. Cl.
CPC ..... *G04B 13/00* (2013.01)
USPC ..... 368/238; 368/76; 368/220

(58) Field of Classification Search
USPC ..... 368/76, 80–81, 220, 228, 238
See application file for complete search history.

(56) References Cited

U.S. PATENT DOCUMENTS 1,465,045 A * 8/1923 Kern ..... 368/220
1,797,912 A 3/1931 Hammond
2,281,494 A * 4/1942 Hammond ..... 368/220
2,432,416 A 12/1947 Haydon
D186,071 S * 9/1959 Golden ..... D19/64
3,183,659 A * 5/1965 Etienne ..... 368/220
3,595,010 A * 7/1971 Kaiser ..... 368/76
5,380,206 A * 1/1995 Asprey ..... 434/257
5,465,239 A * 11/1995 Koch ..... 368/72
D389,767 S * 1/1998 DeNufrio ..... D10/126
6,327,226 B1 * 12/2001 Russi ..... 368/228
6,366,540 B1 * 4/2002 Kaminsky ..... 368/228
7,134,784 B1 * 11/2006 Marin ..... 368/295
7,339,856 B1 * 3/2008 Hardesty ..... 368/228
7,581,873 B2 * 9/2009 Gyger et al. ..... 368/296

* cited by examiner

*Primary Examiner* — Sean Kayes
(74) *Attorney, Agent, or Firm* — LaMorte & Associates, P.C.

(57) ABSTRACT

A clock assembly containing a specialized clockwork. The clockwork contains a hub of three concentric posts upon which are mounted the second hand, minute hand, and hour hand of the clock. The post that connects to the second hand is the widest and shortest post on the hub. Consequently, when a second hand is connected to this outer-most post, the second hand can rotate under the minute hand and the hour hand closest to the clock face. By positioning the second hand post on the exterior of the hub, a 1:1 ratio can be maintained between the rotations of the clock motor and the rotations of the second hand post. This enables the full power of the motor to be transferred to the second hand post. Accordingly, the clockwork is capable of move, large, heavy, and unbalanced second hands.

15 Claims, 5 Drawing Sheets

CLOCKWORK MECHANISM THAT ENABLES A SECOND HAND TO BE POSITIONED BELOW THE HOUR HAND AND THE MINUTE HAND ON A CLOCK FACE

RELATED APPLICATIONS

This application claims the benefit of provisional patent application No. 61/830,634, filed Jun. 3, 2013.

BACKGROUND OF THE INVENTION

1. Field of the Invention

In general, the present invention relates to clockworks for clocks that have an hour hand, a minute hand, and a second hand that emanate from a common hub on a clock face. More particularly, the present invention relates to the gearing assembly used within the clockwork.

2. Prior Art Description

Mechanical timepieces, in the form of clocks and watches, have been in existence for hundreds of years. In this long history, the mechanical clockworks that run the clocks have been designed in countless shapes that vary from large clock towers to small wristwatches.

Most clocks with mechanical movements rotate an hour hand and a minute hand around a clock face. Many clocks also include a second hand. Often the hour hand, the minute hand, and the second hand rotate about a common hub in the center of the clock face. Such a prior art clock configuration is shown in FIG. 1.

Referring to FIG. 1, it can be seen that the hour hand 10, the minute hand 12, and the second hand 14 are all connected to separate, but concentric posts 16, 18, 20. Each of the posts 16, 18, 20 attach to a gearbox 22 within the clock. The gearbox 22 is driven by a clock motor 24. The clock motor 24 may be an electrical motor, a spring wound motor, or a weight and pendulum motor, depending upon the design of the clock.

In prior art clock works, the hours post 16, minutes post 18, and seconds post 20 are concentric. The hours post 16 is the outer-most and shortest of the posts. Conversely, the seconds post 20 is the inner-most and tallest of the posts. The minutes post 18 is interposed between the hours post 16 and the seconds post 20. The hour hand 10 attaches to the hours post 16. Likewise, the minute hand 12 attaches to the minutes post 18 and the second hand 14 attaches to the seconds post 20. This configuration enables the second hand 14 to rotate freely above the minute hand 12 and the hour hand 10. In this manner, the second hand 14 is least likely bind with the other slower moving hands. The common prior art configuration is contained in numerous patents and commercial products and is exemplified by the clockworks shown in U.S. Pat. No. 1,797,912 to Hammond, and U.S. Pat. No. 2,432,416 to Haydon.

Although connecting the second hand to the tallest, center post is practical, it does present limitations to a clock's design. Since the area on the center post available to anchor the second hand 14 is very small, the clock is required to have a very lightweight second hand. Furthermore, the second hand often must be balanced about its attachment point. A lightweight/balanced second hand limits the torque experienced by the thin center post and prevents the center post from twisting or bending. A lightweight/balanced second hand also inhibits the second hand from drooping and eventually contacting the underlying minute hand. Since the second hand must be made with very little mass, it limits the ability of clock designers to create specialty clocks, especially decorative themed clocks, where decorative objects move with the second hand.

For example, suppose a clock designer wants to design a clock with a racing car theme where a racecar is attached to the second hand of the clock. The clock designer may want the racecar to ride upon the clock face and circle the clock face every minute. Using a conventional prior art clockwork mechanism, such a clock cannot be made functional. The mass of the car would be too much for the second hand to bear. This would cause the second hand and/or the post of the second hand to bend. Additionally, the clockworks do not provide the seconds post the torque needed to rotate any object of significant mass. Furthermore, the racecar cannot ride upon the clock face because it would contact the underlying hour hand and minute hand.

A need therefore exists for a clockwork mechanism that bypasses the design limitations of clockworks with conventional second hands, therein enabling more complex, interesting and artistic clocks to be built. This need is met by the present invention as described and claimed below.

SUMMARY OF THE INVENTION

The present invention is a clock assembly containing a specialized clockwork. The clockwork contains a hub of two or three concentric posts upon which can be mounted a minute hand, an hour hand and, if required, a second hand of the clock. The post that connects to the minute hand is concentrically positioned outside the post that moves the hour hand. Likewise, the post that connects to the second hand is concentrically positioned outside the post that moves the minute hand. This makes the second hand the widest and shortest post on the hub. Consequently, when a second hand is connected to this outer-most post, the second hand can rotate under the minute hand and the hour hand closest to the clock face. This hub structure also enables the minute hand to rotate under the hour hand.

Additionally, by positioning the second hand post on the exterior of the hub, a 1:1 ratio can be maintained between the rotations of the clock motor and the rotations of the second hand post. This enables the full power of the motor to be transferred to the second hand post. Accordingly, the clockwork is capable of move, large, heavy and unbalanced second hands without adversely affecting the clock. This enables more complex clock faces to be designed and utilized.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention clockwork mechanism can be embodied in many ways, the embodiment illustrated shows the clockwork being used for a simple table clock or wall clock. This embodiment is selected in order to set forth one of the best modes contemplated for the invention. The illustrated embodiment, however, is merely exemplary and should not be considered a limitation when interpreting the scope of the appended claims.

Figure 1:
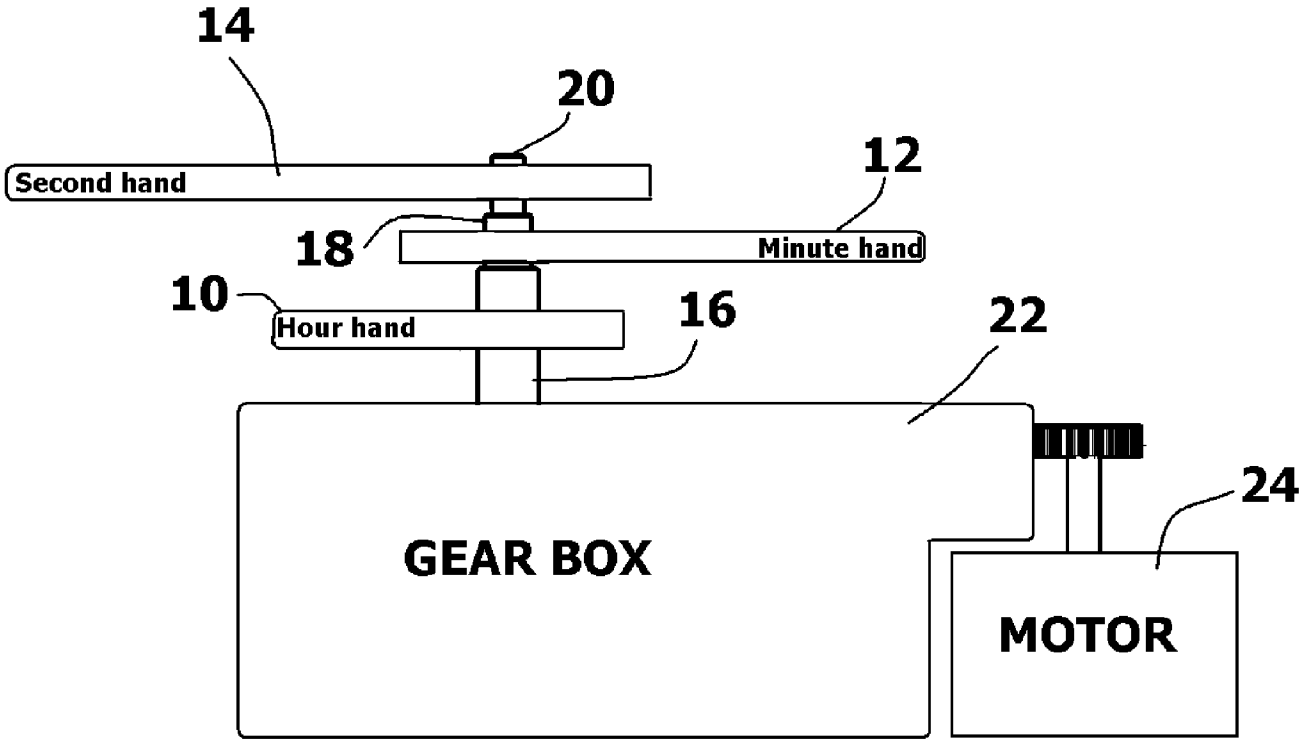
FIG. 1 PRIOR ART
FIG. 1 is a schematic showing the posts and hands of a conventional prior art clockwork.
Figure 2:
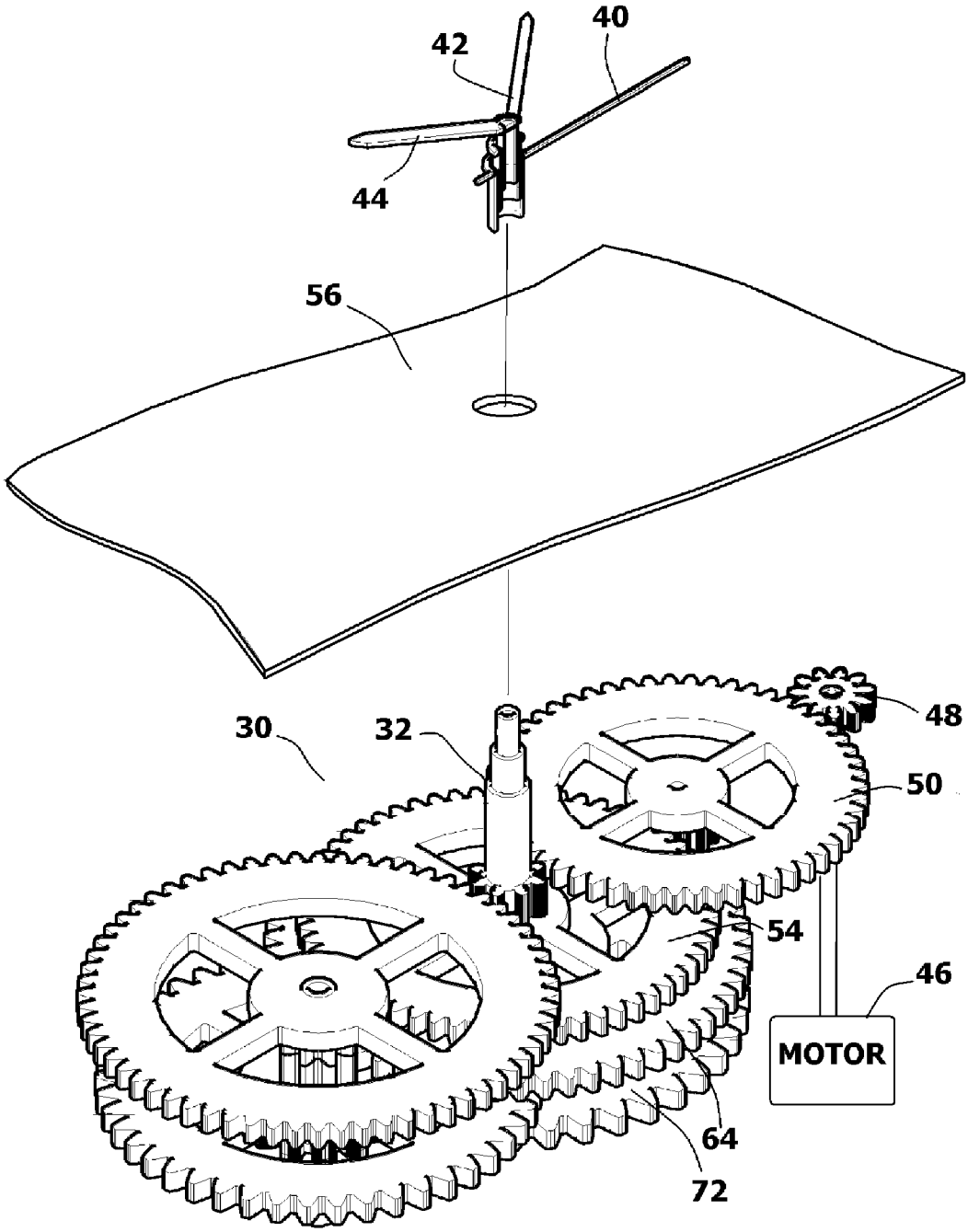
FIG. 2 is a perspective view of an exemplary embodiment of a clockwork, shown in conjunction with a segment of a clock face and the hands of a clock.
Figure 3:
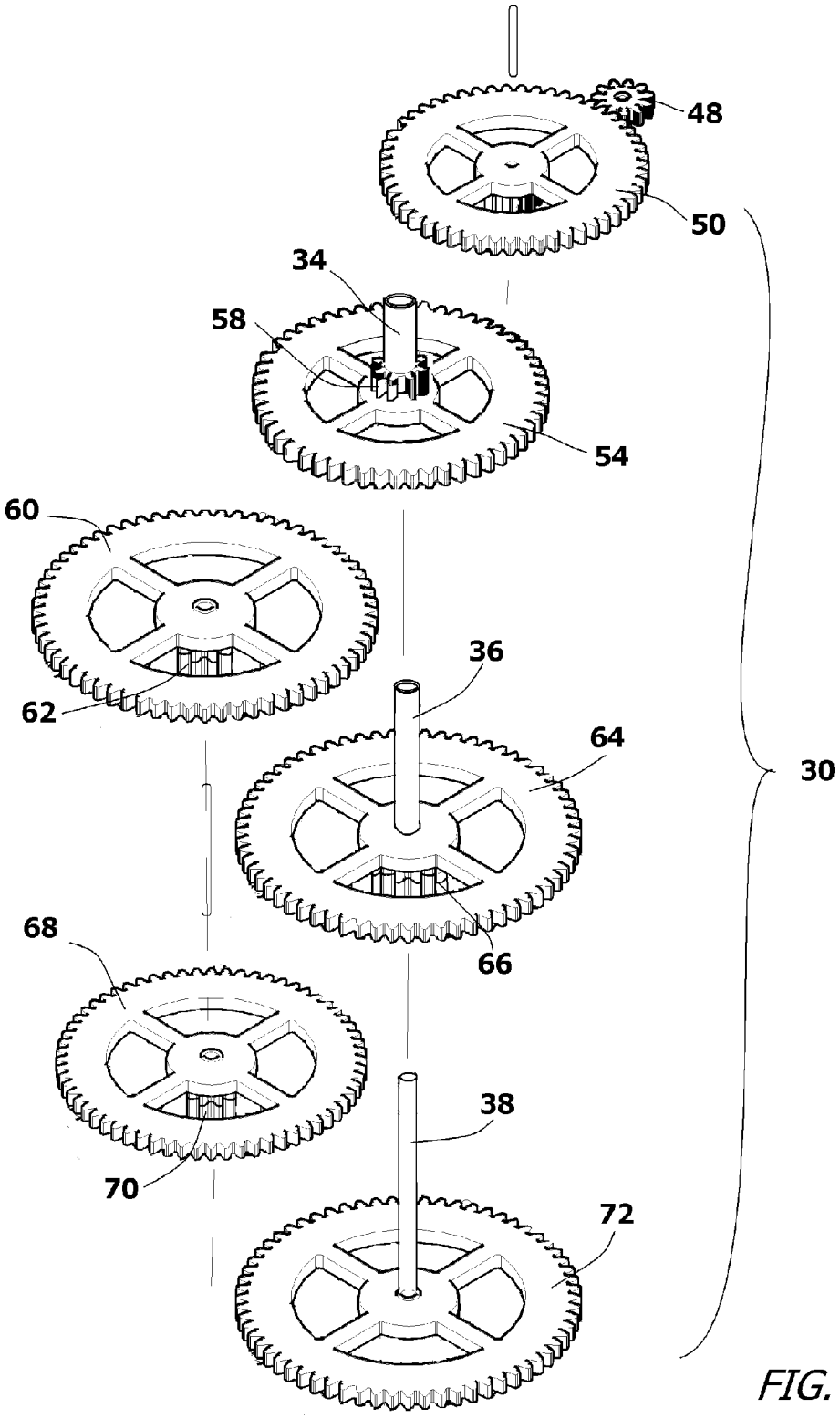
FIG. 3 is an exploded view of the clockwork shown in FIG. 2.
Figure 4:
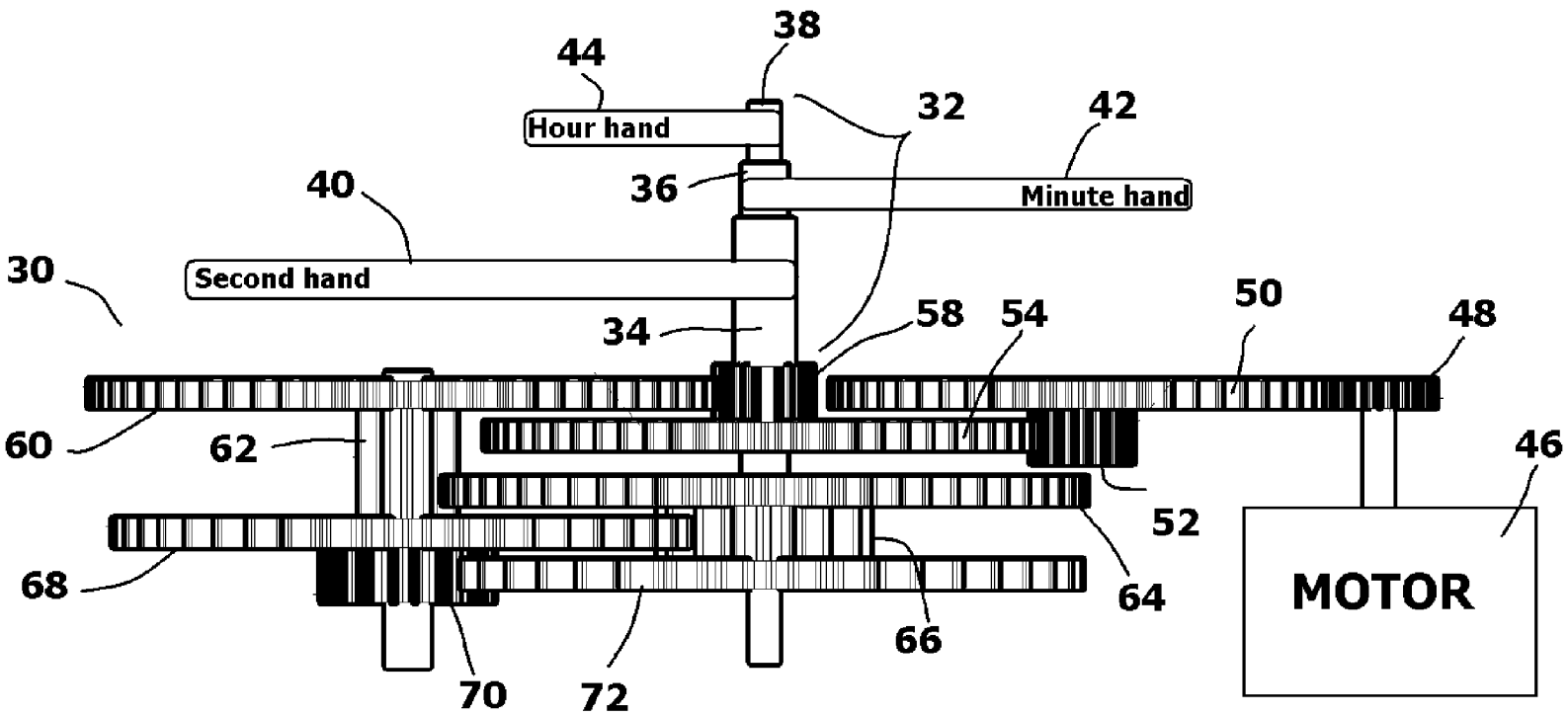
FIG. 4 is a side view of the clockwork shown in FIG. 2.

Referring to FIG. 2 in conjunction with FIG. 3 and FIG. 4, a clockwork mechanism 30 is shown. The clockwork mechanism 30 has hub 32 that contains three concentric posts. Those concentric posts include a seconds post 34, a minutes post 36, and an hours post 38. As can be seen, the seconds post 34 is the widest post and is located on the outside of the hub 32. The seconds post 34 is also the shortest post in the hub 32. The hour post 38 is located in the center of the hub 32 and is the thinnest and longest post in the hub 32. The minutes post 36 is interposed between the inner hours post 38 and the outer seconds post 34. In this manner, it will be understood that when a second hand 40 is attached to the seconds post 34, the second hand 40 can move underneath both a minute hand 42 and an hour hand 44. Likewise, the minute hand 42 can move underneath the hour hand 44 and above the second hand 40.

The clockwork 30 is powered by a clock motor 46. The clock motor 46 has a drive pinion 48. The clock motor 46 can be electrical, spring-loaded or pendulum based, depending upon the design of the overall clock desired.

The drive pinion 48 intermeshes with a first transfer gear 50. A first conjoined pinion gear 52 is concentrically formed under the center of the first transfer gear 50. The first conjoined pinion gear 52 intermeshes with a seconds gear 54. The seconds gear 54 is connected to the seconds post 34 on the exterior of the hub 32. The first transfer gear 50, the first conjoined pinion gear 52 and the seconds gear 54 combine to provide a 1:1 rotational ratio between the drive pinion 48 and the seconds post 34. Accordingly, as the drive pinion 48 completes one full rotation every minute, it causes the seconds post 34 to rotate fully every minute. Consequently, any second hand 40 that would be attached to the seconds post 34 would circle a clock face 56 every sixty seconds. The 1:1 ratio between the rotation of the drive pinion 48 and the rotation of the seconds post 34 provides significant torsion power to the seconds post 34. The torsion power available is equal to that produced by the clock motor 46. Consequently, a second hand of any mass can be utilized, provided the clock motor 46 is sized to provide the torque needed to rotate the mass of the second hand being utilized.

A second conjoined pinion gear 58 is concentrically affixed to the center of the seconds gear 54. As such, the second conjoined pinion gear 58 rotates one revolution every sixty seconds along with the seconds gear 54 and the seconds post 34. The second conjoined pinion gear 58 engages a large second transfer gear 60. A third conjoined pinion gear 62 is attached to the underside of the second transfer gear 60, wherein the second transfer gear 60 and the third conjoined pinion gear 62 are concentric.

The minutes post 36 is rigidly affixed to the center of a minutes gear 64. The minutes gear 64 is positioned below the seconds gear 54, wherein the minutes post 36 extends up and through the seconds post 34. The minutes post 36 terminates at an elevation above the top of the seconds post 34. The minutes gear 64 intermeshes with the third conjoined pinion gear 62. The second conjoined pinion gear 58, the second transfer gear 60, the third conjoined pinion gear 62 and the minutes gear 64 all combine to create a 60:1 rotational ratio. As such, the minutes gear 64 and the minutes post 36 will complete a full rotation every sixty minutes. That is, a full rotation will occur after sixty full rotations of the seconds post 34.

A fourth conjoined pinion gear 66 is concentrically affixed to the center of the minutes gear 64. As such, the fourth conjoined pinion gear 66 rotates at one revolution every sixty minutes along with the minutes gear 64 and the minutes post 36. The fourth conjoined pinion gear 66 engages a large third transfer gear 68. A fifth conjoined pinion gear 70 is attached to the underside of the third transfer gear 68, wherein the third transfer gear 68 and the fifth conjoined pinion gear 70 are concentric.

The hours post 38 is rigidly affixed to the center of an hours gear 72. The hours gear 72 is positioned below both the minutes gear 64 and the seconds gear 54. The hours post 38 extends up and through the minutes post 36 and the second post 34. The hours post 38 terminates at an elevation above the top of both the minutes post 36 and the seconds post 34. The hours gear 72 intermeshes with the fifth conjoined pinion gear 70. The fourth conjoined pinion gear 66, the third transfer gear 68, the fifth conjoined pinion gear 70, and the hours gear 72 all combine to create a 1:12 rotational ratio. As such, the hours gear 72 and the hours post 38 will complete one full rotation every twelve hours. That is, a full rotation will occur after twelve full rotations of the minutes post 36.

In the final assembly of the clockwork 30, the hours gear 72, minutes gear 64 and seconds gear 54 are all concentrically aligned. The seconds gear 54 is closest to the clock face 56 and the hours gear 72 is farthest from the clock face 56. The minutes gear 64 is interposed between the seconds gear 54 and the hours gear 72. The hours post 38, that extends from the hours gear 72, is the longest, thinnest post. The seconds post 34, that extends from the seconds gear 54, is the shortest, widest post. The minutes post 36 is between the hours post 38 and second post 34 in both diameter and height.

The hours post 38 extends through and beyond the minutes post 36. The seconds post 34 extends through and beyond both the hours post 38 and the minute post 36. Sections of the concentric hours post 38, minutes post 36 and seconds post 34 extend through the clock face 56 and form the hub 32. The second hand 40, minute hand 42 and hour hand 44 all attach to the hub, wherein the second hand 40 is below the minute hand 42 and the minute hand 42 is below the hour hand 44.

Figure 5:
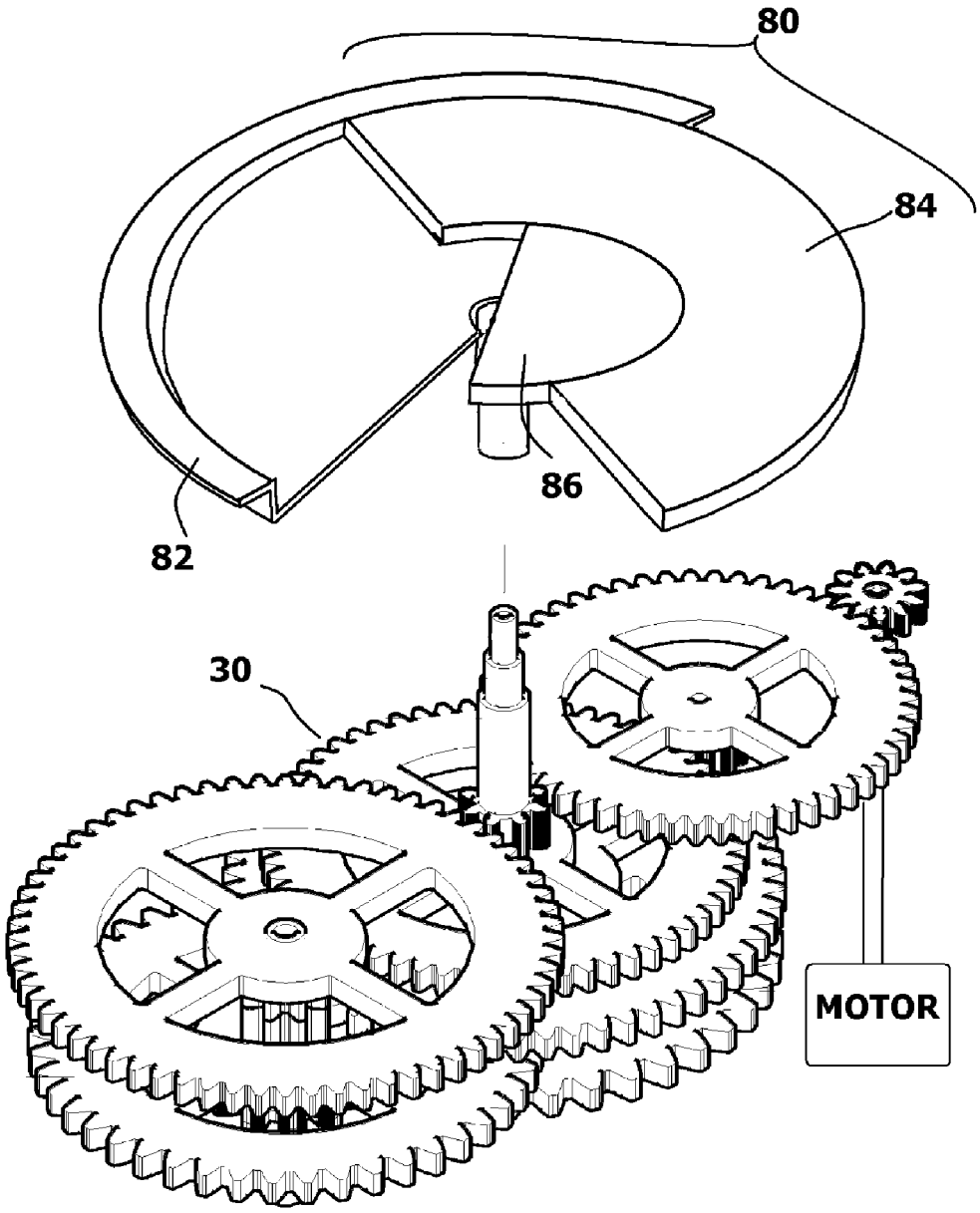
FIG. 5 is an alternate embodiment showing non-conventional clock hands made possible by the present invention clockwork.

Referring to FIG. 5, the same clockwork 30 as has been previously described is again shown. As such, all previous reference numbers used in the description of the clockwork 30 will be maintained. In FIG. 5, an alternate embodiment of the clock hands 80 is shown. Due to the 1:1 gear ratio between the clock motor 24 and the seconds post 34, the full power of the clock motor 24 can be experienced by the seconds post 34. This enables large, heavier second hands to be used.

In FIG. 5, the second hand 82, minute hand 84 and hour hand 86 are fabricated as concentric semicircular discs. The clock hands 80 rotate about the hub 32. Lightweight hands no longer need be used. Rather, the clockwork 30 is capable of rotating large unbalanced clock hands 80. Accordingly, clocks can be manufactured with more interesting and complex faces.

It will be understood that the embodiments of the present invention that are illustrated and described are merely exemplary and that a person skilled in the art can make many variations to those embodiments. All such embodiments are intended to be included within the scope of the present invention as defined by the claims.

What is claimed is:

1. A clockwork mechanism, comprising:

an hours post affixed to an hour gear;

a minutes post affixed to a minutes gear;

a seconds post affixed to a seconds gear, wherein said hours post concentrically extends through said minutes post and said minutes post concentrically extends through said seconds post to form a hub upon which a second hand, a minute hand and an hour hand can be attached; wherein the hour, minute, and second hands rotate in a full circle; and the hour, minute, and second hands do not overlap in an axial direction.

2. The mechanism according to claim 1, wherein said seconds post extends beyond said minutes post on said hub and said minutes post extends beyond said hours post on said hub.

3. The mechanism according to claim 1, further including a clock motor that turns a drive pinion.

4. The mechanism according to claim 3, further including a first set of gearing that interconnects said seconds gear to said drive pinion.

5. The mechanism according to claim 4, wherein said first set of gearing produces a 1:1 rotational ratio between said drive pinion and said seconds post.

6. The mechanism according to claim 4, further including a second set of gearing that interconnects said seconds gear to said minutes gear.

7. The mechanism according to claim 6, further including a third set of gearing that interconnects said minutes gear to said hours gear.

8. A clock assembly, comprising:

a clock face;

a second hand;

a minute hand;

an hour hand;

a clockwork mechanism having an hours post, a minutes post, and a seconds post that are concentrically aligned and form a hub that extend through said clock face, wherein said second hand, said minute hand and said hour hand attach to said hub, and wherein said hours post concentrically extends through said minutes post and said minutes post concentrically extends through said seconds post; wherein the hour, minute, and second hands rotate in a full circle; and the hour, minute, and second hands do not overlap in an axial direction.

9. The assembly according to claim 8, wherein said seconds post extends farther from said clock face than said minutes post at said hub.

10. The assembly according to claim 8, further including a clock motor that turns a drive pinion.

11. The assembly according to claim 9, wherein said minutes post extends farther from said clock face than said hour post at said hub.

12. The assembly according to claim 10, wherein said clockwork mechanism includes a first set of gearing that interconnects said seconds post to said drive pinion.

13. The assembly according to claim 12, wherein said first set of gearing produces a 1:1 rotational ratio between said drive pinion and said seconds post.

14. The assembly according to claim 9, wherein said second hand attaches to said seconds post on said hub and rotates about said hub between said clock face and said minute hand.

15. The assembly according to claim 9, wherein said second hand, said minute and said hour hand are all semicircular in shape.

* * * * *